United States Patent [19]

Reusch, Sr.

[11] Patent Number: 4,928,668

[45] Date of Patent: May 29, 1990

[54] FIREPLACE DAMPER INDICATOR

[75] Inventor: Frederick J. Reusch, Sr., Melville Towers, Apt. 616, New Bedford, Mass. 02740

[73] Assignees: Frederick J. Reusch, Sr., New Bedford; J. Reusch, Jr.; Paul R. Reusch, Sr., Mattepoisett, all of Mass.

[21] Appl. No.: 425,112

[22] Filed: Oct. 23, 1989

[51] Int. Cl.[5] ..... F24B 7/00

[52] U.S. Cl. ..... 126/537; 126/285 R; 126/286; 126/295

[58] Field of Search ..... 126/537, 539, 286, 285 R, 126/285 B, 295; 137/554

[56] References Cited

U.S. PATENT DOCUMENTS 2,194,583 3/1940 Benjamin ..... 126/537

3,773,028 11/1973 Schreibeis ..... 126/285 B

*Primary Examiner*—Carroll B. Dority

*Attorney, Agent, or Firm*—Barlow & Barlow, Ltd.

[57] ABSTRACT

An indicator for a fireplace damper door includes a spiral wire and a contact arm that may engage the wire. The arrangement is such that upon a multiple number of rotations of the contact arm, continual contact is maintained. The arm and wire are is an electrical series circuit with an indicator lamp, which will be illuminated when the damper is opened.

2 Claims, 1 Drawing Sheet

FIREPLACE DAMPER INDICATOR

BACKGROUND OF THE INVENTION

This invention relates to a device to indicate whether a fireplace damper is open or closed. Fireplace dampers are controlled by two distinct means; one being a lever mechanism which is generally an open or a closed situation and alternately, by a worm screw which requires many turns and will regulate the damper between fully opened and closed position. The instant invention is directed to the latter form. The problem with utilizing a multi-turn damper lies primarily in the fact that one can easily leave the damper in a partially closed position and in a situation where warmth is being supplied by a heating system, some of that heat will escape up the flue if the fireplace is not in use. There have been, for example, some disclosures of damper indicators which indicate the continual position of a damper on a meter as, for example, in the Smith patent, U.S. Pat. No. 2,393,482, where a d c servo arrangement is illustrated. For the lever type of damper, an arrangement as seen in the Beyer, et al patent, U.S. Pat. No. 4,350,142, was noted but this arrangement does not suggest a means for solving the problem of a screw-type damper control where the only reliable way of ascertaining the position is to look up the chimney.

SUMMARY OF THE INVENTION

An indication of open or closed position of a damper controlled by a multi-turn screw shaft is achieved by having a coupler mounted within a housing, the shaft being adapted to receive a portion of the screw shaft of the damper rod and at the other end to provide means for attaching a handle. The coupler carries a contact arm which is fixed to the coupler and the contact arm cooperates with a fixed brush that is electrically connected as part of a series circuit with a source of e.m.f. A spiral contact wire arrangement is provided about the coupler and the spiral conductive wire is connected in a series circuit with an indicator which may be in the form of a lamp, to a source of voltage, such as a battery, which, as previously noted, is in series with the contact arm. When the arm is engaged with the wire, a circuit is established so that the indicator, if it be a lamp, is lit. On the other hand, means are provided whereby there is a dead space or non-contact "off" space without means of engaging the wire, which dead space would be the closed position of the damper. The arrangement is such that an indicator is provided which gives a positive indication of the damper position and which is reliable and is simple to operate.

DESCRIPTION OF THE PREFERRED EMBODIMENT

Figure 6:
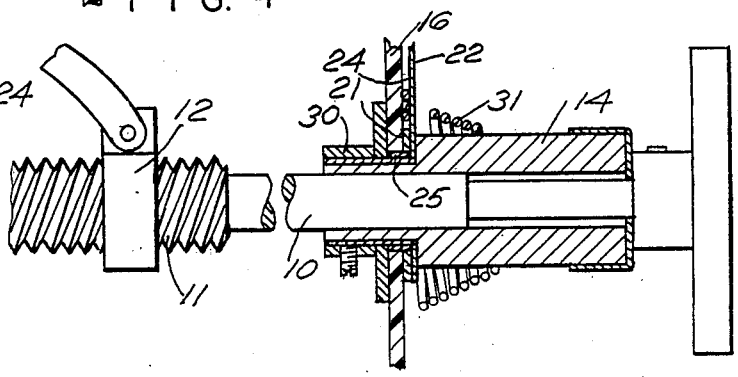
FIG. 6 is a detached fragmental sectional view taken on lines 6—6 of FIG. 5 showing the damper control screw.

With reference to the drawings and referring first to FIG. 6, there is illustrated a fragmentary view of a damper shaft 10 which has a helical screw portion 11 upon which rides a nut 12. The nut 12 is connected to a damper door via an arm and linkage, as well known to those skilled in the art, and the arrangement is such that the nut traverses the length of the helical screw from a fully closed to an open position of the damper door. The shaft 10 is received in a cylindrical coupler 14 so that the coupler 14 rotates with the shaft 10. Coupler 14 passes through an aperture in an insulating plate 16 and has a reduced outer surface as indicated at 18 which forms a step 19. Upon this reduced surface, there is fitted a bearing sleeve 20. A brush 21 interconnects with a finger 22 which is basically of strip of insulation with a conductor portion on one side thereof as indicated at 24. A fixed ring plate 26 engages a conductive plug 25 that passes through plate 16 so that an electrical path is made between 24, 21, 25 and 26. A collar 30 retains the coupler 14 in position relative to the insulating plate 16.

About the coupler 14 there is arranged a spirally wound wire which is fixed to the insulating plate as at 32 from which point a conductor leads to a terminal 36 on a lamp base, generally indicated at 38, while the other terminal of the lamp is represented by the mounting bracket 39 and is connected to one side of a battery 40 while the other side of the battery 40 is connected as via conductor 41 to the brush 26. It will of course be understood that a suitable low voltage supply from a transformer can be substituted for the battery 40.

Figure 1:
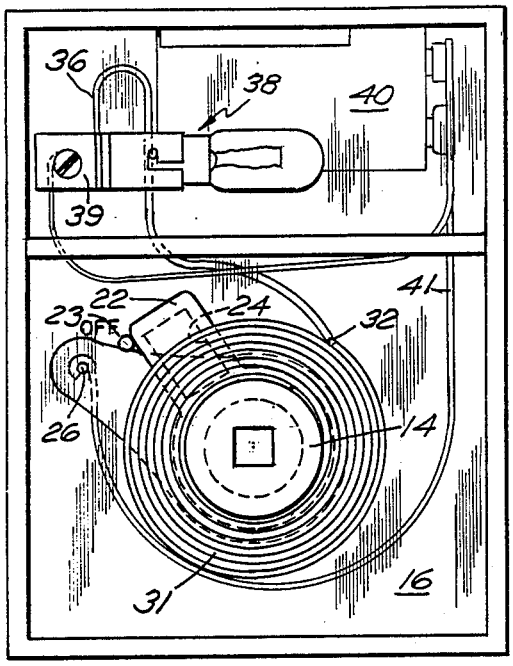
FIG. 1 is a front plan view of the indicator mechanism.
Figure 2:
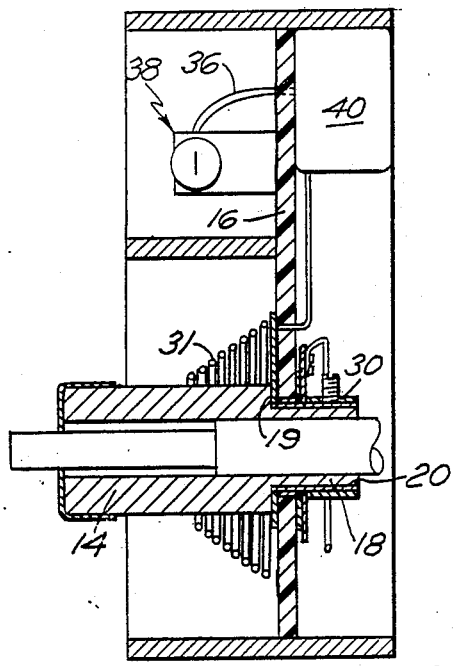
FIG. 2 is a side view thereof.
Figure 3:
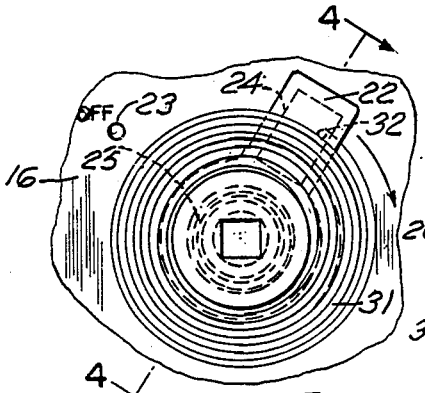
FIG. 3 is a detailed fragmental view illustrating the contact arm engaging the wire.
Figure 4:
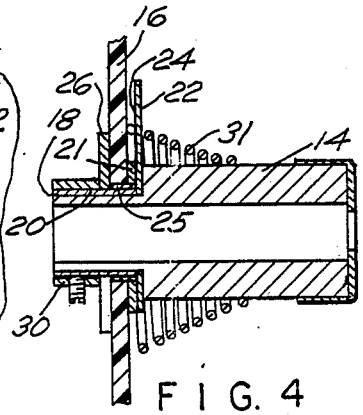
FIG. 4 is a side view of the arm as seen in FIG. 3 taken on lines 4—4 of FIG. 3.
Figure 7:
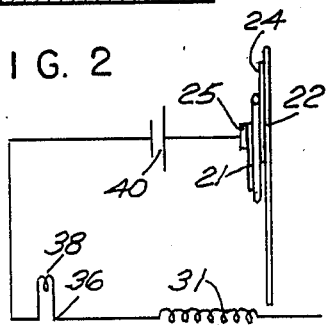
FIG. 7 is an electrical diagram illustrating one form of the circuit.
Figure 5:
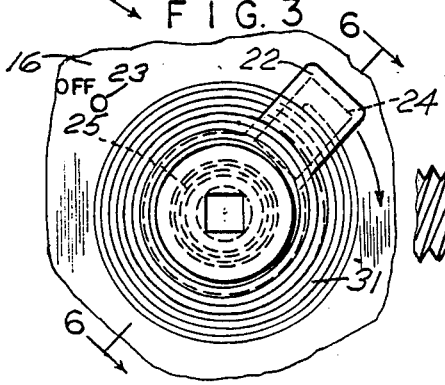
FIG. 5 is a fragmental plan view of the arm after many turns.

In the normal "off" position as seen in FIG. 1, the arm 22 is lying against a stop pin 23 located on the insulating plate 16. In operation, the damper shaft 10 will be coupled for rotation with collar 14 so that in the at rest position as seen in FIG. 1, the contact arm 22 will be lying against the stop pin 23 and on a portion of insulating plate 16 so that no circuit is established. Once the shaft 10 is turned to open the damper, the contact arm 22 will rotate clockwise as seen in FIG. 1 and engage the first convolution of the spiral coil 31 as seen in FIGS. 3 and 4. Further rotation, as for example three turns, will bring three of the convolutions underneath the arm 22, all of which is readily permitted by the fact that the coil 31 is arranged with decreasing diameter convolutions so that the convolutions will lay and nest along side of each other as the arm is continually rotated. It will be apparent that throughout this position the lamp 38 will be illuminated as a complete series circuit is completed as seen in FIG. 7, and thus an open damper is indicated. It will be apparent that the housing will be formed in a variety of forms to satisfy the requirements of decor and will have a suitable cover plate to enclose the mechanism that has been described above.

I claim:

1. A fireplace damper indicator comprising a housing having a central cylindrical coupler mounted therein for rotation, said coupler having a bore to receive a damper operating rod, means gripping the rod, a contact arm fixed to the shaft, spiral contact wire means arranged to engage the arm, a no-contact area adjacent a circular path traversed by the arm, indicator means, a source of e.m.f., means establishing a circuit with the arm, wire, e.m.f and an indicator whereby the indicator shows open or closed damper position.

2. A fireplace damper door indicator for revealing an open or closed position of a damper door comprising a helical screw, a nut means engaging the screw, a linkage means coupling the nut and damper door, said screw having an operating shaft extension, a cylindrical coupler engaging said shaft, said coupler having an arm connected thereto that has an electrical contact thereon, a spiral wire encircling the coupling and having one end thereof connected in circuit with an indicator lamp, said arm normally lying adjacent an end of said spiral wire whereby when the arm is rotated it physically engages the wire and the contact thereon completes a circuit with the indicator lamp indicating the open position of the damper door.

* * * * *